US010557266B2

(12) United States Patent
Carr et al.

(10) Patent No.: US 10,557,266 B2
(45) Date of Patent: Feb. 11, 2020

(54) GIRDERS, JOISTS AND ROOF SYSTEM

(71) Applicant: AUSTIN BUILDING AND DESIGN INC., Cleveland, OH (US)

(72) Inventors: Gregory James Carr, Branchburg, NJ (US); Barry Allen Rogers, Novelty, OH (US); James Brandon Davis, Chesterland, OH (US); Alex Sestak, North Ridgeville, OH (US); Jeffrey J. Morris, Streetsboro, OH (US); Herman J. Miller, Jr., Mentor, OH (US)

(73) Assignee: AUSTIN BUILDING AND DESIGN INC., Cleveland, OH (US)

( * ) Notice: Subject to any disclaimer, the term of this patent is extended or adjusted under 35 U.S.C. 154(b) by 15 days.

(21) Appl. No.: 15/981,507

(22) Filed: May 16, 2018

(65) Prior Publication Data

US 2018/0347193 A1 Dec. 6, 2018

Related U.S. Application Data

(60) Provisional application No. 62/514,090, filed on Jun. 2, 2017.

(51) Int. Cl.
*E04B 1/18* (2006.01)
*E04C 3/08* (2006.01)
(Continued)

(52) U.S. Cl.
CPC ..... *E04C 3/08* (2013.01); *E04C 3/09* (2013.01); *E04B 7/022* (2013.01);
(Continued)

(58) Field of Classification Search
CPC . E04C 3/02; E04C 3/125; E04C 3/127; E04C 2003/0491; E04C 2003/0447;
(Continued)

(56) References Cited

U.S. PATENT DOCUMENTS 1,649,577 A 11/1927 Coryell
2,001,215 A 5/1935 Ruppel
(Continued)

FOREIGN PATENT DOCUMENTS

EP 0211671 A1 2/1987
FR 2289694 A1 5/1976
(Continued)

OTHER PUBLICATIONS

Yan Brudka, Trubchatye stalnye konstruktsii.(Tube Steel Structures), M., Stroiizdat, 1975, p. 61, 62, fig. 1U.13 (see explanation of relevance in attached International Search Report and Written Opinion in PCT/US2018/032977).
(Continued)

*Primary Examiner* — Chi Q Nguyen
(74) *Attorney, Agent, or Firm* — Pearne & Gordon LLP

(57) ABSTRACT

A roof system including roof support and roof, preferably a flat roof. The roof support includes (a) a plurality of first joists and (b) a plurality of second joists. Each first joist acts as a roof girder. Each second joist extends between a pair of adjacent first joists. Each first joist and each second joist includes a top chord, a bottom chord and web members connecting the chords. Each top chord is hollow, rectangular cross section and sealed; each bottom chord and web member is preferably a hollow sealed pipe. As a result the roof support can be made of joists with a minimum of flat surfaces and nooks and crannies where dust and particles can collect, so that the roof support is easier to wash and regularly sanitize.

23 Claims, 3 Drawing Sheets

(51) Int. Cl.
*E04C 3/09* (2006.01)
*E04B 7/02* (2006.01)
*E04H 5/02* (2006.01)
*E04C 3/04* (2006.01)

(52) U.S. Cl.
CPC ... *E04B 2103/06* (2013.01); *E04C 2003/0491* (2013.01); *E04H 5/02* (2013.01)

(58) Field of Classification Search
CPC ..... E04C 2003/0486; E04C 2003/043; E04C 3/09; E04B 7/022
USPC ..... 52/636, 633, 693, 289, 634, 690, 691, 52/639, 643, 702, 712
See application file for complete search history.

(56) References Cited

U.S. PATENT DOCUMENTS 3,036,676 A 5/1962 Jotzsch
3,438,076 A * 4/1969 Hugo ..... E01D 15/133 14/14
3,551,237 A * 12/1970 Cox ..... B29C 53/564 156/175
3,708,928 A * 1/1973 Gaspers ..... E04B 1/24 52/93.1
3,785,109 A * 1/1974 Letourneur ..... E04B 1/19 52/633
3,893,276 A 7/1975 Brown
3,925,951 A 12/1975 Jackson et al.
4,253,210 A 3/1981 Racicot
4,378,263 A * 3/1983 Logan ..... B29C 70/36 118/428
5,313,749 A 5/1994 Conner
5,435,110 A * 7/1995 Stol ..... B62D 23/005 403/170
D381,097 S 7/1997 Hing
5,651,229 A 7/1997 Wada et al.
5,761,873 A * 6/1998 Slater ..... E04B 1/08 52/633
6,009,914 A 1/2000 Castano
6,065,267 A 5/2000 Fisher
6,170,217 B1 * 1/2001 Meyer ..... E04B 1/24 29/897.31
6,237,299 B1 5/2001 Gortan
6,912,787 B1 7/2005 Ruble et al.
6,993,881 B1 2/2006 Ruble et al.
7,231,745 B1 6/2007 Shoji
8,291,673 B2 10/2012 Straight, Jr.
8,316,621 B2 * 11/2012 Safari Kermanshahi ..... E04C 3/086 52/234
8,726,606 B2 * 5/2014 Strickland ..... E04C 3/07 52/636
8,800,238 B2 8/2014 Davies
9,010,061 B2 4/2015 Podjadtke
2001/0020353 A1 9/2001 Carr
2002/0005022 A1 1/2002 Matthews
2005/0163564 A1 * 7/2005 Tuell ..... E04B 1/5831 403/403
2014/0338279 A1 11/2014 Armbrust et al.

FOREIGN PATENT DOCUMENTS

WO 2006008176 A1 1/2006
WO 2006081679 A1 8/2006

OTHER PUBLICATIONS

Spravochnik proektirovtzika (Designer Handbook), Metallicheskie konstruktzii (Metal Structures). Pod red.(Editor) N.P. Melnikova, 1980, p. 275-276, fig. 15.18 (see explanation of relevance in attached International Search Report and Written Opinion in PCT/US2018/032977).
Food Processing Plant, https://steeljoist.org Feb. 24, 2017, https://steeljoist.org/projects/allencanningcompany/, Feb. 24, 2017, 1 page.
Vulcraft, "Joists & Joist Girders", http://www.vulcraft.com Feb. 24, 2017, http://www.vulcraft.com/joistsjoistgirders, Feb. 24, 2017, 1 page.
Canam Buildings, "Joists and Joist Girders" https://www.canamconstruction.com Feb. 24, 2017, https://www.canamconstruction.com/en/constructionproducts/steeljoist/, Feb. 24, 2017, 3 pages.

* cited by examiner

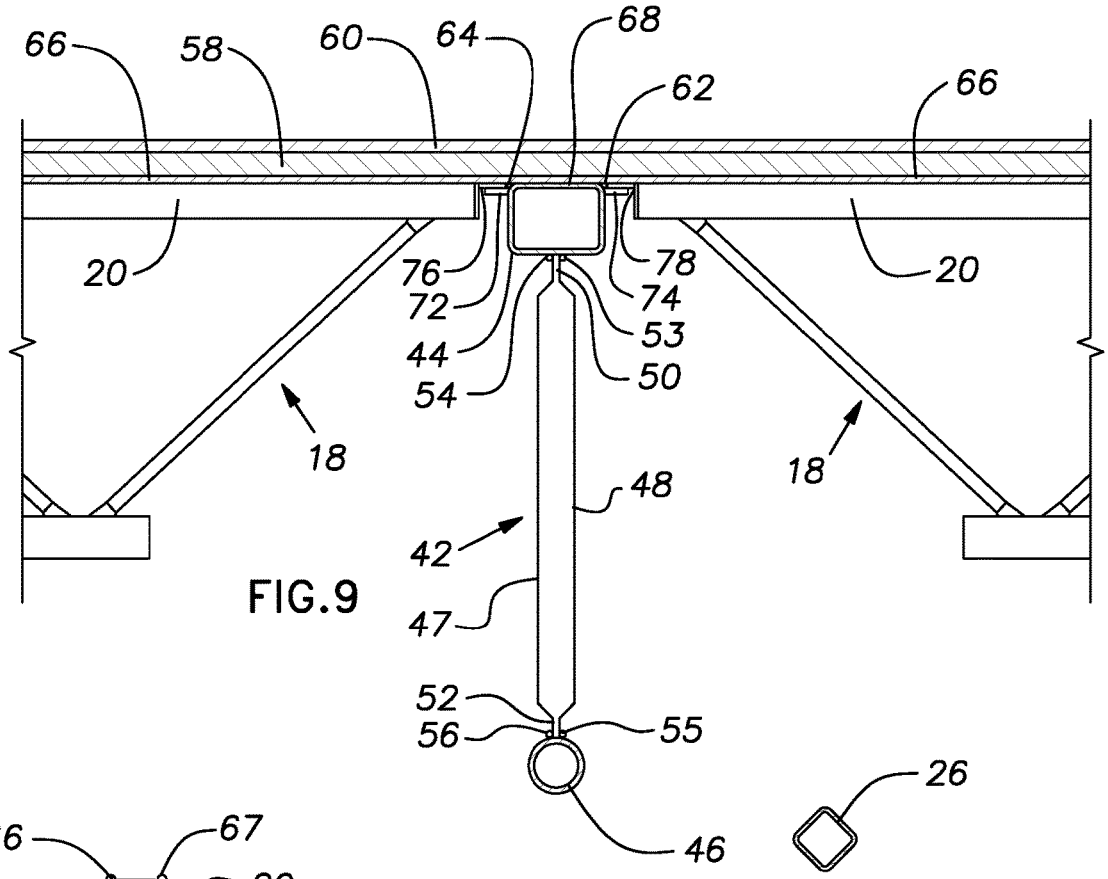
FIG.9
FIG.8
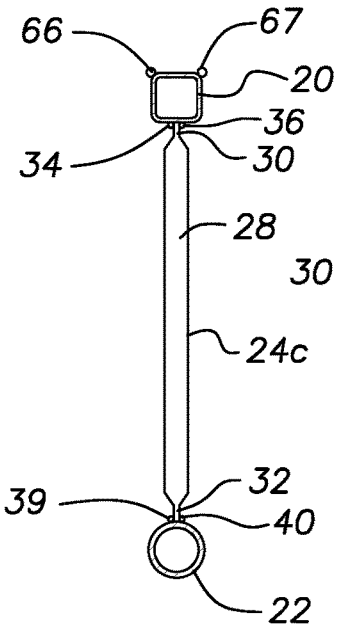
FIG.6
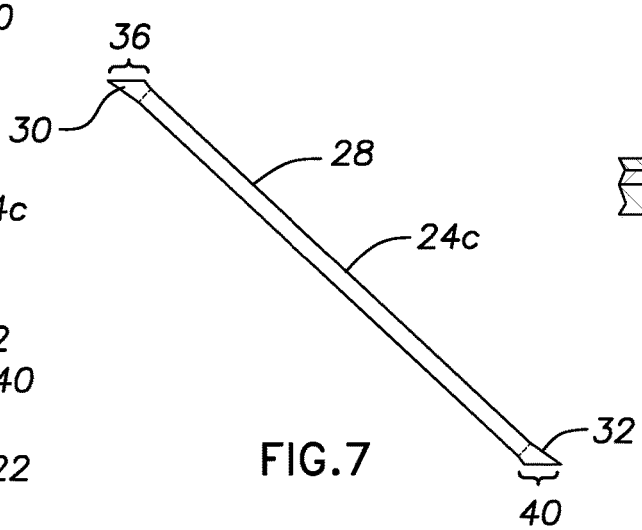
FIG.7
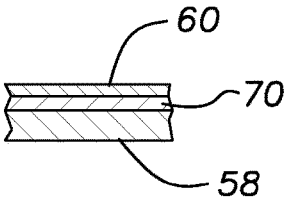
FIG.10

GIRDERS, JOISTS AND ROOF SYSTEM

This application claims the benefit of US Provisional Patent Application No. 62/514,090 filed on Jun. 2, 2017, the entire consents of which is hereby incorporated herein by reference.

FIELD OF THE INVENTION

The invention relates to a roof system comprising roof support and roof, preferably a flat roof, preferably for a food or pharmaceutical manufacturing plant. Such a roof is usually supported by girders and joists.

DESCRIPTION OF RELATED ART

In a typical food plant or pharmaceutical plant, there will be several large rooms containing food or pharmaceutical processing equipment, where the food, etc., is processed and packaged by the workers. The roof of the building will typically be 15-25 feet (4.6-7.6 m) above the floor and the food processing equipment. The flat roof of the building will be supported by a large number of horizontal steel girders and joists. Strict regulations require that the entire room, including the steel girders and joists, be regularly cleaned and sanitized.

In the prior art, the steel girders and joists of a food plant have many flat surfaces, crevices, and nooks and crannies where dust, grease and tiny food particles can collect and where microbial growth can occur. Because of the nooks and crannies, it is difficult to effectively remove the dust, grease and particles and sanitize all the surfaces of the steel girders and joists.

There is a need in food plants and pharmaceutical plants for steel girders and joists having a minimum of flat surfaces, nooks and crannies, so that the girders and joists can be more effectively washed, cleaned and sanitized.

FIG. 1 shows a top plan view of the steel support members (roof support) according to the prior art which support the flat roof, such as of a food plant. FIG. 1 shows five girders 4, each one perhaps 40 feet (12.2 m) long, 8 inches (20.3 cm) wide and 24 inches (61 cm) high. Each girder 4 has two ends 2, 3. Each end 2, 3 is supported from the floor of the food plant by a large long steel post (see, e.g., post 5, girder 4 and joist 6*a* of FIG. 2) which is perhaps 20 feet (6.1 m) high (if the height of the roof of the plant is about 20 feet (6.1 m)). FIG. 1 shows seven joists 6 spanning the gap between adjacent girders 4. Each joist is, for example, 40 feet (12.2 m) long, 3 inches (7.6 cm) wide and 30 inches (76 cm) high. The girders 4 support the joists 6 and the steel posts 5 support the girders 4. Each girder 4 is traditionally a strong I-beam, also called a wide flange girder; a type of strong I-beam is shown at 4 in FIG. 2.

Traditionally, each joist 6 is a bar joist, such as the conventional steel bar joist 6 shown in FIG. 3. With reference to FIG. 3, each bar joist 6 has a top chord 8, a bottom chord 10, and web members 12. As shown in FIG. 3, the top chord 8 can be a pair of angle irons 8*a*, 8*b* and the bottom chord 10 can be a pair of angle irons 10*a*, 10*b*. A plate 9 can be provided to rest on the top of girder 4 (see, e.g., FIG. 2). Typically, each web member 12 can be a solid steel bar, or an angle iron with its ends squashed to fit between the two angle irons 8*a*, 8*b* in the top chord 8 and between the two angle irons 10*a*, 10*b* in the bottom chord 10. FIG. 2 shows how each end of the bar joist 6 or 6*a* can be supported by the girder or I-beam 4.

It is also known in the prior art, instead of using the bar joist 6, 6*a* (that is, the joist 6 in FIG. 1), to instead use a joist which is called a rectangular steel tube joist or HSS joist. HSS stands for Hollow Structural Section. FIG. 4 shows (not to scale) a rectangular steel tube joist or HSS joist 16 which would be the same length as the bar joist 6, 6*a*, that is, about 30 to 50 feet (9.1-15.2 m). To make HSS joist 16, you take a piece of rectangular HSS steel which is hollow and open at both ends (the HSS piece is about 30-50 feet (9.1-15.2 m) long). Then you weld a steel plate over each end so that you end up with a sealed, hollow steel box about 30-50 feet (9.1-15.2 m) long. FIG. 4 shows this hollow box (not to scale), having sides 16*a* (top), 16*b* (front), 16*c* (back), 16*d* (bottom) from the HSS piece, and the two steel plates 16*e* and 16*f* which have been welded to seal the ends, to form the sealed box. HSS joist 16 is then used in FIG. 1 in place of joist 6.

The problem with the bar joist 6, 6*a* is that it has too many flat surfaces to collect dust and too many nooks and crannies to collect microbial growth and dust and which can't be reached to clean.

The problem with the rectangular steel tube joist or HSS joist 16 is that, although it has few nooks and crannies, it is expensive because of all the steel used to make the sealed box. Also, this design with HSS joists 16 still uses girders 4, (see FIG. 1) which are I-beams which collect lots of dust on the horizontal flanges.

SUMMARY OF THE INVENTION

A joist comprising a top chord, a bottom chord and a plurality of web members connecting the top chord to the bottom chord, the top chord being hollow, having a rectangular lateral cross section and having two ends which are sealed, the bottom chord being hollow and having two ends which are sealed. A roof system can include one or more of these joists.

BRIEF DESCRIPTION OF THE DRAWINGS

FIG. 6 is a cross-sectional view taken along line 6-6 of FIG. 5;

FIG. 7 is an enlarged front elevational view of web member 24*c;*

FIG. 8 is a cross-sectional view of an alternative embodiment of a bottom chord of a DSTWW joist according to the invention;

FIG. 9 is a cross-sectional view of a portion of a roof system according to the invention; and FIG. 10 is a cross-sectional view of an alternative embodiment of a portion of a roof according to the invention.

DETAILED DESCRIPTION OF PREFERRED EMBODIMENTS OF THE INVENTION

In the description that follows, when a preferred range, such as 5 to 25 (or 5-25) is given, this means preferably at least 5 and, separately and independently, preferably not more than 25. As used herein and in the claims, DSTWW joist means double sealed tube with web joist.

The present invention preferably includes 2 parts. First, you replace each bar joist/HSS joist 6 (in FIG. 1) with a double sealed tube with web joist; that is, with a DSTWW joist. Second, you replace each girder 4 (in FIG. 1) with a larger version of a DSTWW joist.

Figure 5:
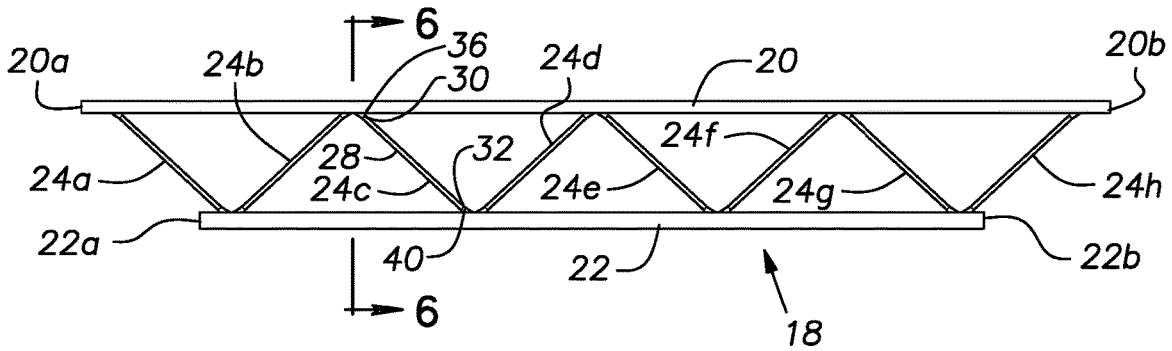
FIG. 5 is a front elevational view of a double sealed tube with web (DSTWW) joist according to the invention.

FIG. 5 shows a DSTWW joist 18. Joist 18 comprises a top chord 20, a bottom chord 22 and web members 24*a*, 24*b*, 24*c*, 24*d*, 24*e*, 24*f*, 24*g*, 24*h*. DSTWW joist 18 is a conventional length, with the joist 18 and the top chord 20 being typically about 25-60 or 30-50 feet (7.6-18.3 or 9.1-15.2 m) long. The gap between top chord 20 and bottom chord 22 is preferably about 18-42 or 24-36 inches (45.7-106.7 or 61-91.4 cm). (FIG. 5 is for illustration only and is not to scale; there will usually be more than 8 web members in a 30-50 foot (9.1-15.2 m) DSTWW joist 18). Preferably all the triangles formed between the chords are isosceles triangles. As shown in FIG. 5, the chords and web members define a series of alternately inverted triangle-shaped spaces, preferably isosceles triangles, along the length of the joist (like a Neville truss); alternatively the triangles are equilateral triangles (like a Warren truss). Each web member 24*a* etc. is preferably about 20-36, 20-30, or 24-36, or about 24, inches (50.8-91.4, 50.8-76.2, or 61-91.4, or about 61, cm) long. FIG. 6 shows a cross sectional view of the DSTWW joist 18 taken along line 6-6 of FIG. 5. As shown in FIG. 6, top chord 20 is a square HSS tube (alternatively, it can be rectangular); the ends 20*a*, 20*b* have been sealed by welding a square steel plate (alternatively, it can be rectangular) to seal each end. As shown in FIG. 6, top chord 20 has a square and a rectangular lateral cross section. Top chord 20 is preferably about 2-4 or about 3 inches (5.1-10.2 or about 7.6 cm) wide and about 2-4 or about 3 inches (5.1-10.2 or about 7.6 cm) high (outside dimensions) and with about 0.25 inch (about 0.64 cm) wall thickness. As shown in FIG. 6, bottom chord 22 is a circular HSS steel pipe preferably about 2-5 or 2.5-4.5 or about 3.5 inches (about 5.1-12.7 or 6.4-11.4 or about 8.9 cm) in outside diameter; and about 0.2-0.25 inch (about 0.51-0.64 cm) wall thickness; the ends 22*a*, 22*b* have been sealed by welding a circular steel plate to seal each end. Alternatively, bottom chord 22 can be a square HSS tube 26 (of course sealed at each end like chord 22) (see FIG. 8) which has been tilted to a 45° angle, so that dust will tend to fall off and can be easily washed off. Alternatively, HSS tube 26 can be rectangular, optionally tilted about 30-60° for the same reasons. HSS tube 26 is preferably the same width, height and thickness as top chord 20.

Each web member 24*a-h* is a piece of round steel tube having a circular cross section wherein each end has been squashed flat. Web member 24*c* has a central section 28 which is a round pipe preferably about 1-3 or 1-2 inches (2.5-7.6 or 2.5-5.1 cm) outside diameter; web member 24*c* has a top end 30 and a bottom end 32, wherein the last inch (2.54 cm) or so of the circular pipe has been squashed flat so that the respective ends can be more easily welded to the bottom of the top chord 20 and to the top of the bottom chord 22 (thus sealing the ends of the hollow pipe) and provides a more sanitary connection. Top end 30 is welded to the bottom of top chord 20 with weld beads 34, 36; bottom end 32 is welded to bottom chord 22 with weld beads 38, 40. In summary, each joist 6 of FIG. 1 has been replaced by a DSTWW joist 18.

Figure 1:
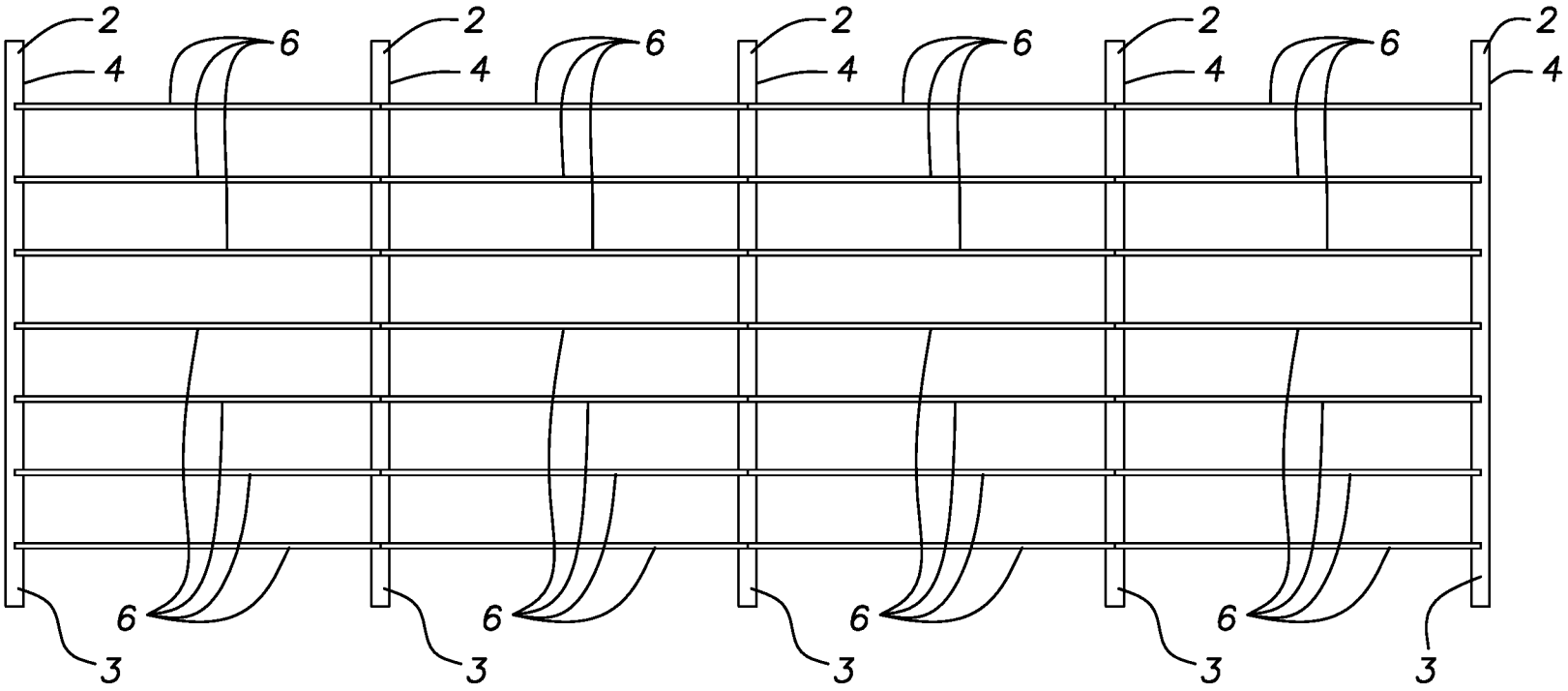
FIG. 1 (PRIOR ART)
FIG. 1 is a top plan view of steel support members of a roof support according to the prior art which supports a flat roof.
Figure 2:
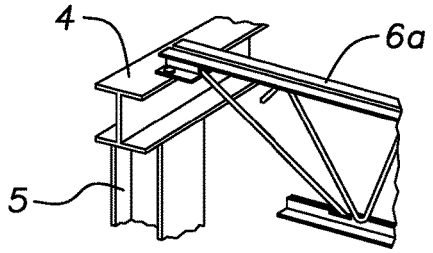
FIG.2 (PRIOR ART)
FIG. 2 is a perspective view of a post, girder and joist according to the prior art.
Figure 3:
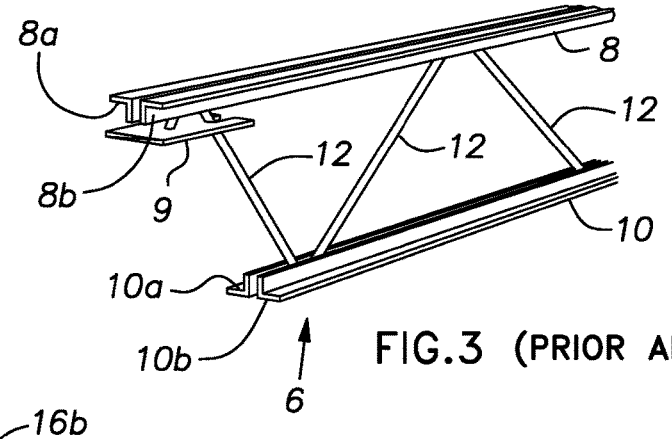
FIG.3 (PRIOR ART)
FIG. 3 is a perspective view of a joist according to the prior art.
Figure 4:
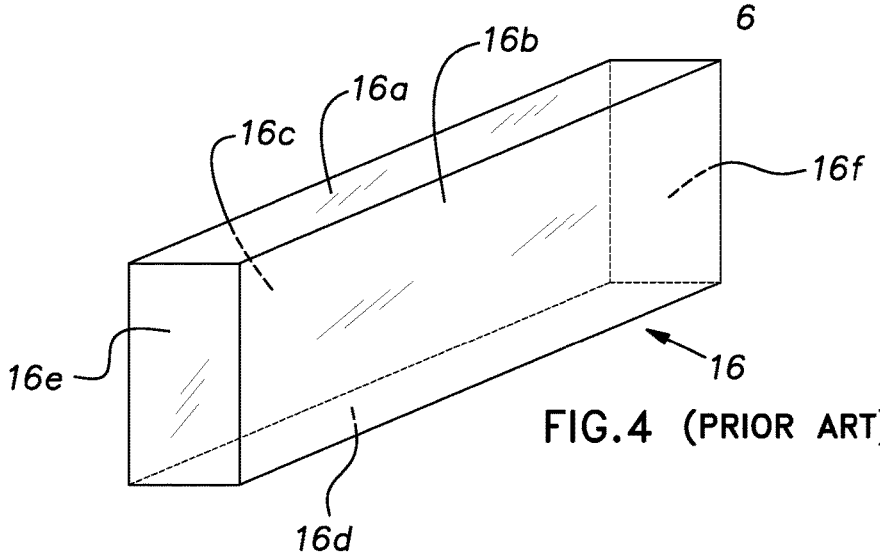
FIG.4 (PRIOR ART)
FIG. 4 is a perspective view of a rectangular steel tube joist according to the prior art.

Next, with reference to FIG. 1, you replace each girder 4 with a DSTWW joist, except that this DSTWW joist is preferably much larger and stronger than DSTWW joist 18. See FIG. 9, which shows DSTWW joist 42, which is larger and stronger than the 2 smaller DSTWW joists 18 (described in FIG. 5) which it supports as shown in FIG. 9. DSTWW joist 42 has the same construction and dimensions and the same triangles as DSTWW joist 18, but it is preferably larger; it has a top chord 44, bottom chord 46 and a web member 47 which is a round pipe, which has a central portion 48. Both ends of chords 44, 46 are sealed like chords 20, 22. Top chord 44, bottom chord 46 and joist 42 are preferably about 25-60, 30-60 or 40-50 feet (7.6-18.3, 9.1-18.3 or 12.2-15.2 m) long; each web member 47 is preferably about 20-60, 34-60 or 36-56 or 36-45 or 40-48 inches (50.8-152, 86.4-152 or 91.4-142 or 91.4-114 or 101.6-122 cm) long. Web member 47 has a top end 50 and a bottom end 52, wherein the last inch (2.54 cm) or so of the circular pipe has been squashed flat just like ends 30, 32 so that each end 50, 52 can be more easily welded to the top chord 44 and bottom chord 46 via weld beads 53, 54, 55, 56 and provides a more sanitary connection. Bottom chord 46 may alternatively be a square or rectangular HSS tube that may optionally be tilted at about 30-60° or 45°, similar to chords/tubes 22 and 26 described above. Top chord 44 is preferably about 2-5 or 2-4 or about 3 inches (5.1-12.7 or 5.1-10.2 or about 7.6 cm) wide and about 2-5 or 2-4 or about 3 inches (5.1-12.7 or 5.1-10.2 or about 7.6 cm) high (outside dimensions) and about 0.25 inch (0.64 cm) wall thickness; bottom chord 46 can be the same as bottom chord 22 or about 10-25-50% larger, web member 47 can be the same as web member 24*a* or about 10-25-50% larger.

To make web members 24*a-h* and 47, preferably take a long length of pipe and, every 20-36 (for 24*a-h*) or 34-60 (for 47) inches (50.1-91.4 or 86.4-152 cm), squash flat an about 3 inch (7.6 cm) section. Then cut the pipe at a 45° angle in the middle of the 3 inch (7.6 cm) flat section. The yields the web members 24*a-h*, 47 with a flat section about 1.5 inches (3.8 cm) long at each end with a 45° cut or tip, with no waste of material.

FIG. 9 shows metal flanges 72, 74 fixed to the sides of top chord 44 and corresponding flanges 76, 78 fixed to the ends of top chords 20, 20 so that DSTWW joists 18, 18 can be mounted on DSTWW joist 42. FIG. 9 also shows the flat roof which is above the girders and joists. First, on top of the joists 18, place a large flat layer of 3 inch (7.6 cm) insulated metal panels (IMP) 58; each IMP panel has a 3 inch (7.6 cm) core of foam insulation and a top skin and a bottom skin of galvanized steel (or steel with baked enamel finish). On top of the layer of IMP panels 58, place a flat layer 60 (not to scale) of thermoplastic polyolefin (TPO) single ply roof membrane or similar material. Preferably, a 0.5 inch (1.3 cm) isolation board layer 70 (see FIG. 10) is placed between the TPO membrane 60 and the IMP panel layer 58. The isolation board can be a polyisocyanurate rigid foam insulation board as known in the art. Other flat roofs known in the art can be used.

To prevent dust and particles collecting between the top 68 of the top chord 44 and the bottom of the IMP panel 58, seal the front and back edges 62, 64 of the top 68 to the bottom of the IMP panel layer 58 with sealant; similarly, seal the front and back edges 66, 67 (see FIG. 6) of the top chord 20 of each DSTWW joist 18 to the bottom of the IMP panel layer 58 with sealant (see FIGS. 6 and 9).

A roof system comprises roof support and roof. The roof support comprises the traditional girders and joists (or the DSTWW joists of the present invention) which support the roof. The roof comprises layers of material like IMP panels and TPO membrane (which are supported by the roof support) to keep snow, rain, weather, etc. out of the building.

The roof system of the present invention preferably comprises (a) a plurality of first joists (preferably like DSTWW joists 42) extending substantially horizontally and substantially parallel to each other (as shown in, e.g., FIGS. 1 and 9) and (b) a plurality of second joists (preferably like DSTWW joists 18). Each first joist acts as a conventional roof girder like girders 4; each second joist extends between and is supported by a pair of adjacent first joists, similar to or like the joists 6 extend between and are supported by a pair of adjacent girders 4 in FIG. 1.

As a result of the roof system using large DSTWW joists 42 for the girders 4 and smaller DSTWW joists 18 for the joists 6, you have a food or pharmaceutical plant roof support with almost no flat surfaces and almost no nooks and crannies. In particular, each DSTWW joist 18, 42 is hollow and sealed, in that each top chord 20, 44, each bottom chord 22, 46 and each web member 24*a-h*, 47 is hollow and sealed, and there are almost no flat surfaces where dust, grease and food particles can collect. The invented roof support and roof system is easier to wash, clean and sanitize. The roof system can preferably include a flat roof with minimal pitch for rainwater drainage and be a roof system of a food manufacturing plant or a pharmaceutical manufacturing plant.

The invention can be used preferably for roofs for the following types of food plants, or plants processing or making these goods: bakery or bakery goods, meat packing or processing, fruits, vegetables, sauces, canned food, bottled food, pet food, cereals, beverages, snack foods, candy, jams, jellies, etc. The invention can be used preferably for pharmaceutical plants making or processing injectables, oral medications, ointments, salves, lotions, etc. and for aseptic processing, wet processing, sterile product filling, tissue culture manufacturing, equipment manufacturing, reagent production, packaging, coating and filling operations, etc. and for electronics plants making electronic chips, electronic components and other electrical devices and goods. The invention can be used in any plant where it is necessary to minimize dust and particles and to sanitize the area.

While the invention has been described with reference to the preferred embodiments, it is understood that various changes can be made and equivalents may be substituted for elements thereof without departing from the scope of the invention.

What is claimed is:

1. A joist comprising a top chord, a bottom chord and a plurality of web members connecting the top chord to the bottom chord, the top chord being hollow, having a rectangular lateral cross section with a flat top and having a first end sealed via a first plate and a second end sealed via a second plate, the bottom chord being hollow and having a first end sealed via a third plate and a second end sealed via a fourth plate.

2. The joist of claim 1, wherein each web member is a hollow pipe with a circular cross section.

3. The joist of claim 2, wherein each web member has a top end squashed flat and a bottom end squashed flat, the top end being welded to a bottom of the top chord, the bottom end being welded to a top of the bottom chord.

4. The joist of claim 1, wherein the bottom chord is a circular pipe having an outside diameter of about 2-5 inches.

5. The joist of claim 1, wherein the chords and web members define a series of alternately inverted triangle-shaped spaces along the length of the joist.

6. The joist of claim 1, wherein the chords and web members define a series of alternately inverted isosceles triangle-shaped spaces along the length of the joist.

7. The joist of claim 1, wherein the top chord is 25-60 feet long.

8. The joist of claim 1, wherein each web member is 20-60 inches long.

9. The joist of claim 1, wherein the top chord has outside dimensions of width of about 2-5 inches and height of about 2-5 inches.

10. The joist of claim 1, wherein the hollow top chord is sealed and wherein the hollow bottom chord is sealed.

11. A roof system comprising (a) a plurality of first joists extending substantially horizontally and substantially parallel to each other and (b) a plurality of second joists, each first joist acting as a roof girder, each second joist extending between and being supported by a pair of adjacent first joists, at least one of said first joists or at least one of said second joists comprising a top chord, a bottom chord and a plurality of web members connecting the top chord to the bottom chord, the top chord being hollow, having a rectangular lateral cross section with a flat top and having a first end sealed via a first plate and a second end sealed via a second plate, the bottom chord being hollow and having a first end sealed via a third plate and a second end sealed via a fourth plate.

12. The roof system of claim 11, wherein each bottom chord is a circular pipe having an outside diameter of about 2-5 inches.

13. The roof system of claim 11, wherein, for each first and second joist, the chords and web members define a series of alternately inverted triangle-shaped spaces along the length of the joist.

14. A roof system comprising (a) a plurality of first joists extending substantially horizontally and substantially parallel to each other and (b) a plurality of second joists, each first joist acting as a roof girder, each second joist extending between and being supported by a pair of adjacent first joists, wherein each of said first joists and each of said second joists comprises a top chord, a bottom chord and a plurality of web members connecting the top chord to the bottom chord, the top chord being hollow, having a rectangular lateral cross section with a flat top and having a first end sealed via a first plate and a second end sealed via a second plate, the bottom chord being hollow and having a first end sealed via a third plate and a second end sealed via a fourth plate.

15. The roof system of claim 14, wherein each web member is a hollow pipe with a circular cross section.

16. The roof system of claim 15, wherein each web member has a top end squashed flat and a bottom end squashed flat, the top end being welded to a bottom of the top chord, the bottom end being welded to a top of the bottom chord.

17. The roof system of claim 14, wherein each top chord is 25-60 feet long.

18. The roof system of claim 14, wherein each web member is 20-60 inches long.

19. The roof system of claim 14, wherein each top chord has outside dimensions of width of about 2-5 inches and height of about 2-5 inches.

20. The roof system of claim 14, said roof system including a flat roof and being a roof system of a food manufacturing plant or a pharmaceutical manufacturing plant.

21. The roof system of claim 14, wherein the top chord of each first joist has a flat top surface having a front edge and a back edge, said front and back edges extending longitudinally with respect to said top chord of said first joist, said front and back edges being sealed with sealant to an underside of a roof of the roof system to prevent infiltration of dust and particles.

22. The roof system of claim 21, wherein the top chord of each second joist has a flat top surface having a front edge and a back edge, said front and back edges extending longitudinally with respect to said top chord of said second joist, said front and back edges being sealed with sealant to the underside of said roof to prevent infiltration of dust and particles.

23. The roof system of claim 14, wherein said hollow top chord is sealed and wherein said hollow bottom chord has a circular cross section and is sealed.

* * * * *